US010186357B2

(12) United States Patent
Tada

(10) Patent No.: US 10,186,357 B2
(45) Date of Patent: Jan. 22, 2019

(54) R-T-B BASED SINTERED MAGNET

(71) Applicant: TDK CORPORATION, Tokyo (JP)

(72) Inventor: Atsushi Tada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 329 days.

(21) Appl. No.: 15/130,375

(22) Filed: Apr. 15, 2016

(65) Prior Publication Data

US 2016/0307675 A1 Oct. 20, 2016

(30) Foreign Application Priority Data

Apr. 15, 2015 (JP) ..... 2015-083007

(51) Int. Cl.
*H01F 1/053* (2006.01)
*H01F 1/057* (2006.01)

(52) U.S. Cl.
CPC ..... *H01F 1/0536* (2013.01); *H01F 1/0577* (2013.01)

(58) Field of Classification Search
CPC ..... H01F 1/0536; H01F 1/0577
See application file for complete search history.

(56) References Cited

U.S. PATENT DOCUMENTS

2005/0183792 A1* 8/2005 Chou ..... H01F 1/0536 148/105
2009/0224615 A1* 9/2009 Komuro ..... H01F 41/0293 310/46
2014/0311291 A1 10/2014 Enokido et al.

FOREIGN PATENT DOCUMENTS

| | | | |
|---|---|---|---|
| JP | S5946008 | A | 3/1984 |
| JP | H04-6806 | A | 1/1992 |
| JP | H11-309549 | A | 11/1999 |
| JP | 2010-074084 | A | 4/2010 |
| JP | 2014-132628 | A | 7/2014 |
| JP | 2014-216339 | A | 11/2014 |

* cited by examiner

*Primary Examiner* — Jessee R Roe
(74) *Attorney, Agent, or Firm* — Oliff PLC

(57) ABSTRACT

An R-T-B based sintered magnet including a main phase composed of an $R_2T_{14}B$ (wherein, R is at least one selected from the group consisting of Y, Ce, La, Pr, Nd, Sm, Eu and Gd; and T is one or more transition metal elements with Fe as necessity) structure, wherein the R-T-B based sintered magnet has a grain boundary phase containing Ce, Fe and Co, and the cross-section area ratio of the grain boundary phase containing Ce, Fe and Co in a unit cross-section area is 1.0% or more and 5.0% or less.

1 Claim, No Drawings

R-T-B BASED SINTERED MAGNET

The present invention relates to an R-T-B based sintered magnet, and particularly to a magnet having an excellent corrosion resistance.

BACKGROUND

The R-T-B based sintered magnet (R is rare earth element(s), T is one or more transition metal elements with Fe as necessity, and B is boron) with the tetragonal compound $R_2T_{14}B$ as the main phase is known to have excellent magnetic properties and has been a representative permanent magnet with high performance since the invention in 1982 (Patent document 1).

Especially, the R-T-B based sintered magnets with the rare earth element(s) R being consisted of Nd, Pr, Dy, Ho and Tb have a large anisotropic magnetic field Ha and are widely used as permanent magnet materials. Among them, the $Nd_2Fe_{14}B$ based sintered magnet having Nd as the rare earth element R is widely used in livelihood, industries, and transportation equipments because it has a good balance among saturation magnetization Is, Curie temperature Tc and anisotropic magnetic field Ha. However, it is well known that the corrosion resistance of the R-T-B based sintered magnet is relatively low because the magnet contains rare earth elements as the main component.

Herein, the mechanism of the corrosion was considered as follows. First, if the water from the water vapor or the like in a use environment adheres to the surface of the sintered magnet, a cell reaction occurs due to a potential difference generated between the main phase and the grain boundary phase. In this process, hydrogen is produced. The produced hydrogen is stored in an R-rich phase and thus the R-rich phase is changed to hydroxide. In addition, in the cell reaction of the water and the R-rich phase stored with hydrogen, hydrogen in an amount more than that stored in the R-rich phase is produced. Accompanying with the reaction, the volume of the grain boundary part expands so that main phase grains are caused to fall off. As the result, a newly formed surface of the R-T-B based sintered magnet emerges and the reaction progresses inside the magnet.

With respect to the problem, in Patent Document 2, a method is proposed to improve the corrosion resistance by homogeneously dissolving a specified amount of Co as a solid-solution in the R-rich phase. This is considered that the potential difference between the main phase and the grain boundary phase becomes small and the cell reaction is suppressed effectively by dissolving Co as the solid-solution in the R-rich phase. Thus, the corrosion resistance is improved.

PATENT DOCUMENTS

Patent document 1: JPS59-46008A
Patent document 2: JPH4-6806A

SUMMARY

However, in Patent Document 2, when Co is homogeneously dissolved in the R-rich phase as the solid-solution, it also enters into the main phase, i.e., $R_2T_{14}B$ phase, in a form of substituting Fe. Thus, Fe in the main phase is substituted at a level more than that as needed. As a result, a problem is caused that the magnetic properties especially the coercivity are decreased.

The present invention has been made by considering the above conditions, and the object of the present invention is to provide an R-T-B based sintered magnet with the corrosion resistance improved and the decrease of the magnetic properties suppressed.

Based on the object, the relation between the type of the grain boundary phase and the corrosion resistance have been studied repeatedly. As a result, it has been discovered that when a specified amount of Co is dissolved in the grain boundary phase as the solid solution in order to improve the corrosion resistance, if Ce and Fe exist in the grain boundary phase in a specified amount, Co will be stabilized by forming a Ce—Fe—Co intermetallic compound and will not substitute the Fe in the main phase. Thus, the decrease of the coercivity can be suppressed. The present invention is made based on the discovery. The present invention is characterized in that it is an R-T-B based sintered magnet containing a main phase composed of an $R_2T_{14}B$ (wherein, R is at least one selected from the group consisted of Y, Ce, La, Pr, Nd, Sm, Eu and Gd; and T is one or more transition metal elements with Fe as the necessity) structure, the R-T-B based sintered magnet has a grain boundary phase containing Ce, Fe and Co, and the ratio of the cross-section area of the grain boundary phase containing the Ce, Fe and Co occupied in the unit cross-section area is 1.0% or more and 5.0% or less.

Herein, a unit cross-section area refers to an area of 50 μm square observed in the structure of the sintered body using a scanning electron microscope (hereinafter, denoted as SEM for convenience).

By the mentioned structure, an R-T-B based sintered magnet as follows can be obtained. That is, when Co is dissolved in the grain boundary phase as the solid solution in order to improve the corrosion resistance, if Ce and Fe exist in the grain boundary phase in a specified amount, Co will be stabilized by forming a Ce—Fe—Co intermetallic compound and will not substitute the Fe in the main phase. Thus, the decrease of the coercivity is suppressed.

As a preferred embodiment of the present invention, the Co atom concentration in the grain boundary phase containing Ce, Fe and Co is preferred to be 0.5 at % or more and 5.0 at % or less. By the structure mentioned above, the potential difference between the main phase and the grain boundary phase is minimized and the cell reaction can be effectively suppressed. Thus, an R-T-B based sintered magnet with a sufficiently high corrosion resistance can be obtained.

Further, as a preferred embodiment of the present invention, the ratio of the Ce atom concentration relative to the sum of the Ce atom concentration, Fe atom concentration and Co atom concentration in the grain boundary phase containing Ce, Fe and Co is preferred to be 0.20 or more and 0.35 or less. By the structure mentioned above, the optimal ratio of Ce can be obtained for sufficiently stabilizing Co in the grain boundary phase containing Ce, Fe and Co, and Co will not substitute Fe in the main phase. Thus, an R-T-B based sintered magnet without deteriorating the magnetic properties can be obtained.

According to the present invention, an R-T-B based sintered magnet can be obtained with the corrosion resistance improved and the decrease of the magnetic properties suppressed.

DETAILED DESCRIPTION OF EMBODIMENTS

Hereinafter, the present invention will be described in detail based on the embodiments. In addition, the present invention will not be limited to the following contents described in the embodiments and examples. Further, the constituent elements in the following embodiments and examples include those a person ordinary skilled in the art can be easily thought of, those substantially the same and those within the so-called equivalent scopes. Moreover, the constituent elements disclosed in the following embodiments and examples can be appropriately combined or properly selected in use.

The R-T-B based sintered magnet of the present embodiment contains rare earth element(s) of R in a range of 11.5 at % or more and 16.0 at % or less. Herein, the R in the present invention is at least one selected from the group consisted of Y, Ce, La, Pr, Nd, Sm, Eu and Gd. If the content of R is less than 11.5 at %, the generation of $R_2T_{14}B$ phase which is the main phase of the R-T-B based sintered magnet is insufficient and soft magnetic materials such as α-Fe may be deposited, and thus the coercivity significantly decreases. On the other hand, if the content of R is more than 16.0 at %, the volume ratio of the main phase, i.e., $R_2T_{14}B$ phase, decreases and the residual magnetic flux density is reduced.

The R-T-B based sintered magnet of the present embodiment contains T in a range of 75 at % or more and 85 at % or less wherein T is one or more transition metal elements with Fe as the necessity. If the content of T is less than 75 at %, the residual magnetic flux density decreases. On the other hand, if the content of T is more than 85 at %, the coercivity is led to decrease.

The R-T-B based sintered magnet of the present embodiment contains boron (B) in a range of 4.8 at % or more and 6.5 at % or less. When the content of B is less than 4.8 at %, a high coercivity cannot be achieved. On the other hand, if the content of B is more than 6.5 at %, the residual magnetic flux density decreases.

The R-T-B based sintered magnet of the present embodiment contains one or two selected from Al and Cu in a range of 0.01 at % or more and 0.70 at % or less. By containing one or two selected from Al and Cu in such a range, the obtained sintered magnet can have a high coercivity, a high corrosion resistance and improved temperature properties.

The R-T-B based sintered magnet of the present embodiment may contain other elements. For example, elements such as Zr, Ti, Bi, Sn, Ga, Nb, Ta, Si, V, Ag and Ge can be contained properly.

The R-T-B based sintered magnet of the present embodiment prefers to minimize the content of the impurity elements such as oxygen, carbon or the like to the largest extent. Especially, the oxygen and carbon which are believed to be harmful to the magnetic properties are preferred to be 3000 ppm or less in the sintered body in terms of gas amount. The reason is considered as follows. If the oxygen amount is large, the rare earth oxide phase which is a non-magnetic component increases. Further, if the carbon amount is large, the rare earth carbides phase which is a non-magnetic component increases. As a result, the magnetic properties will drop greatly.

The R-T-B based sintered magnet of the present embodiment has a main phase and a grain boundary phase.

The main phase grain of the R-T-B based sintered magnet according to the present embodiment has a crystal structure composed of $R_2T_{14}B$-type tetragonal crystal. In addition, the average grain size of the $R_2T_{14}B$ grain is usually about 1 μm to 15 μm.

The grain boundary phase refers to the phase existing between two adjacent main phase grains and it is different from the main phase.

The grain boundary phase of the R-T-B based sintered magnet according to the present embodiment has an R-rich phase having more R than the $R_2T_{14}B$ main phase. As one kind of the R-rich phase, a grain boundary phase containing Ce, Fe and Co (hereinafter, denoted as CFC phase for convenience) is present. As the other grain boundary phase, a B-rich phase containing much boron (B), a rare earth oxide phase, a rare earth carbide phase, a rare earth nitride phase can be contained.

The CFC phase of the R-T-B based sintered magnet according to the present embodiment contains a Ce—Fe—Co intermetallic compound substituted with Co. The CFC phase is mainly composed of Ce, Fe and Co and it can contain other components.

In the R-T-B based sintered magnet of the present embodiment, the cross-section area ratio of the CFC phase in the unit cross-section area is 1.0% or more and 5.0% or less. If the cross-section area ratio of the CFC phase in the unit cross-section area is less than 1.0%, hydrogen produced by the reaction between water such as water vapor and R cannot be sufficiently prevent from being stored in the grain boundary, and thus the corrosion resistance becomes lower. On the other hand, if the cross-section area ratio of the CFC phase in the unit cross-section area is more than 5.0%, since the volume ratio of the main phase drops, the residual magnetic flux density decreases.

In the R-T-B based sintered magnet of the present embodiment, the Co atom concentration in the CFC phase is 0.5 at % or more and 5.0 at % or less. If the Co atom concentration is lower than 0.5 at % or higher than 5.0 at %, the potential difference between the main phase and the grain boundary phase becomes large, and the corrosion resistance reduces due to the cell reaction. Further, when the Co atom concentration is higher than 5.0 at %, the Co which has not been completely substituted in the Ce—Fe—Co intermetallic compound becomes a soft phase, leading to the decrease of the coercivity.

In the R-T-B based sintered magnet of the present embodiment, the ratio of the Ce atom concentration relative to the sum of the Ce atom concentration, the Fe atom concentration and the Co atom concentration in the CFC phase (hereinafter, denoted as a for convenience) is 0.20 or more and 0.35 or less. If a is lower than 0.20 or higher than 0.35, only a part of Co present in the grain boundary phase forms an intermetallic compound with Ce and Fe and a structure with the Fe in the main phase being substituted by the Co is obtained, and thus the coercivity will be decreased.

Hereinafter, the preferred example of the manufacturing method of the present invention will be described.

In the manufacture of the R-T-B based sintered magnet of the present embodiment, a raw material alloy(s) is prepared to obtain the R-T-B based sintered magnet having a desired composition. The raw material alloy(s) can be prepared by a strip casting method or the other well known melting methods under vacuum or in an inert gas atmosphere, preferably in Ar gas atmosphere. In the strip casting method, the molten solution obtained by melting the starting metals in an inert gas atmosphere such as Ar gas atmosphere is sprayed to the surface of a rotating roll. The molten solution quenched on the roll is rapidly solidified into a shape of sheet. The rapidly-solidified alloy has a homogeneous structure with a grain size of 1.0 to 50.0 μm. The method for preparing the raw material alloy is not limited to the strip casting method, and the raw material alloy can also be obtained by melting methods such as the high frequency induction melting method. Further, in order to prevent the segregation from happening after the melting process, for example, the molten solution can be poured onto a watercooled copper plate so as to be solidified. Also, the alloy obtained by the reduction diffusion method can be used as the raw material alloy.

In the case of obtaining the R-T-B based sintered magnet of the present invention, a single-alloy method for manufacturing the sintered magnet from one kind of alloy used as the raw material alloy is basically applied. Further, in the present embodiment, the case of the single-alloy method is described. Besides, a so-called two-alloy method may also be applied by using a main phase alloy and a grain boundary phase alloy, wherein the main phase alloy has the main phase grains (i.e., $R_2T_{14}B$ crystal grains) as the main part while the grain boundary phase alloy contains more R than the main phase alloy and effectively contributes to the formation of the grain boundary.

The raw material alloy(s) is supplied to a pulverization step. The pulverization step includes a coarse pulverization step and a fine pulverization step. Firstly, the raw material alloy(s) is coarsely pulverized to have a particle size of approximately several hundreds of μm. The coarse pulverization is preferably performed by using a stamp mill, a jaw crusher, a brown mill and the like in the inert gas atmosphere. Before coarse pulverization, it is effective to perform pulverization in which the hydrogen is stored to the raw material alloy and then the hydrogen is released. The hydrogen releasing treatment is performed to reduce hydrogen that becomes the impurities of the R-T-B based sintered magnet. The heating and holding temperature for the hydrogen storage is 200° C. or more, preferably 300° C. or more. The holding time varies depending on the relation with the holding temperature, the thickness of the raw material alloy and etc., but it is at least 30 min or more, preferably 1 hour or more. The hydrogen releasing treatment is preformed under vacuum or in an Ar gas flow. Further, the hydrogen storage treatment and the hydrogen releasing treatment are not necessary. The hydrogen pulverization also can be defined as the coarse pulverization to omit a mechanical coarse pulverization.

The coarsely pulverized powder is supplied to the fine pulverization step. During the fine pulverization, a jet mill is mainly used to pulverize the coarsely pulverized powder with a particle size of approximately several hundreds of pan to be a fine pulverized powder with an average particle size of 2.0 μm or more and 5.5 μm or less, preferably 3.0 μm or more and 5.0 μm or less. The jet mill is used to perform the pulverization method as follows. The jet mill discharges inert gas at a high pressure from a narrow nozzle to produce a high-speeded gas flow. The coarsely pulverized powder is accelerated by this high-speeded gas flow, causing a collision between the coarsely pulverized powder particles or a collision between the coarsely pulverized powder and a target or the wall of a container.

The wet pulverization can also be used in the fine pulverization. In the wet pulverization, a ball mill, or a wet attritor, or the like is used to pulverize the coarsely pulverized powder having a particle size of approximately several hundreds of μm to be a fine pulverized powder having an average particle size of 0.1 μm or more and 5.0 μm or less, preferably 2.0 μm or more and 4.5 μm or less. By selecting a suitable dispersion medium in the wet pulverization, slurry is produced, and the powder of magnet can be pulverized without contacting oxygen. Thus, fine powder with a low concentration of oxygen can be obtained. As the dispersion medium, isopropyl alcohol, ethanol, methanol, ethyl acetate, phosphoric acid esters, pentane, hexane, benzene, toluene, xylene, acetone, methyl ethyl ketone or the like can be selected.

During the fine pulverization, about 0.01 to 0.30 wt % of an fatty acid or an derivative of the fatty acid or an hydrocarbon may be added to improve the lubrication and the orientation property in the pressing step, for example, stearic acids or oleic acids such as zinc stearate, calcium stearate, aluminum stearate, stearic amide, oleic amide, ethylene bis-isostearic amide; hydrocarbons such as paraffin and naphthalene or the like.

The obtained finely pulverized powder is supplied to the pressing step in a magnetic field. The pressure provided during the pressing process in the magnetic field may be in a range of 0.3 ton/cm$^2$ or more and 3.0 ton/cm$^2$ or less (30 MPa or more and 300 MPa or less). The pressure may be constant from the beginning of the pressing to the end, and may also be increased or decreased gradually, or it may be irregularly changed. The lower the pressure, the better the particles oriented. However, if the pressure is too low, problems will occur during handling due to insufficient strength of the green compact, and thus the pressure is selected from the above range in this consideration. The final relative density of the green compact obtained by pressing in the magnetic field is usually 40% or more and 60% or less.

The magnetic field applied is about 10 kOe or more and 20 kOe or less (i.e., 800 kA/m or more and 1600 kA/m or less). The applied magnetic field is not limited to a magnetostatic field, and it may also be a pulsed magnetic field. In addition, a magnetostatic field and a pulsed magnetic field can be used in combination.

From the viewpoint of protecting against the oxidation of the fine powder, the oxidation of the green compact and preventing the oxygen amount in the sintered body from increasing, the pressing step in a magnetic field can be performed in an inert gas atmosphere.

The green compact is subjected to a thermal treatment in an inert gas atmosphere to obtain a porous body. The temperature for the thermal treatment is 800° C. or more and 900° C. or less. The holding time is 30 minutes or more and 120 minutes or less. The thermal treatment is performed until the density of the porous body becomes 1.05 times or more and 1.25 times or less of that of the green compact. If the density of the porous body is less than 1.05 times of that of the green compact, the CFC phase cannot be generated homogenously in the following sintering step and the effect of increasing the corrosion resistance cannot be obtained. In addition, if the density of the porous body is more than 1.25 times of that of the green compact, the whole porous body is not impregnated with the CFC phase, and CFC phase cannot be generated homogenously in the sintering step.

The porous body is coated or impregnated with a mixture of a solvent and the fine powder with a composition composed of Ce, Fe and Co (hereinafter, denoted as slurry for convenience) so that the weight ratio of the mixture becomes 1.0 wt % or more and 5.5 wt % or less relative to the weight of the porous body. The fine powder for slurry can be prepared by preparing an alloy composed of Ce, Fe and Co (i.e., an alloy for slurry) through the same method for preparing the porous body and then providing with a coarse pulverization step and a fine pulverization step. The slurry can be prepared by weighing and then mixing the obtained fine pulverized powder mentioned above and an alcohol-based solvent (such as ethanol, methanol or the like) to obtain a weight ratio of the fine pulverized powder in the slurry of 40 wt % or more and 65 wt % or less. During this process, the mixing method prefers to be a mechanical kneading method using a non-bubbling kneader or the like. In addition, the kneading time is preferred to be 2 minutes or more and 10 minutes or less, and the atmosphere for mixing is preferred to be an inert gas atmosphere in order to prevent a sudden oxidization. If the weight ratio of the slurry coated or impregnated on the surface of the porous body is less than 1.0 wt %, the CFC phase cannot be generated in the whole porous body, the cross-section area ratio of the CFC phase in a unit cross-section area becomes less than 1.0% and the hydrogen storage into the grain boundary cannot be suppressed sufficiently wherein the hydrogen is produced by the reaction between R and water such as water vapor. Thus, the effect of improving the corrosion resistance cannot be obtained. On the other hand, if the ratio mentioned above is more than 5.5 wt %, the cross-section area ratio of the CFC phase in the unit cross-section area is over 5.0%, the volume ratio of the main phase decreases, and thus the residual magnetic flux density will decrease. In this way, the cross-section area ratio of the CFC phase can be adjusted by varying the weight ratio of the slurry coated or impregnated on the porous body.

Next, the porous body coated or impregnated with slurry is sintered under vacuum or in an inert gas atmosphere. The sintering temperature needs to be adjusted according to conditions such as the composition, the pulverization method, the difference of the average particle size and particle size distribution and the like, and the sintering may be performed at 1000° C. or more and 1200° C. or less for 1 hour or more and 8 hours or less. If the sintering time is less than 1 hour, densification cannot be sufficiently provided and the density of the sintered body significantly drops which will cause a bad influence on the magnetic properties. In addition, if the sintering time is more than 8 hours, a significant abnormal grain growth occurs which will cause a bad influence on the magnetic properties, especially the coercivity. A two-step sintering method, a SPS method (i.e., spark plasma sintering method), a microwave sintering method or the like can also be used in order to prevent needless diffusion or grain growth.

The sintered body is provided with an aging treatment in an inert gas atmosphere. This step is an important one for optimizing the grain boundary phase and controlling the coercivity. When the aging treatment is divided into two stages, it is effective to hold at 800° C. nearby and at 500° C. nearby for a predetermined time respectively. If an aging treatment at 800° C. nearby is performed after sintering, the coercivity will be increased. In addition, as an aging treatment at 500° C. nearby may increase the coercivity greatly, it is very effective to perform the aging treatment in two stages from the viewpoint of increasing the coercivity.

As the temperature and the holding time for aging treatment varies depending on conditions, suitable adjustment is needed. For example, the two-stage aging treatment can be performed by not performing the first stage treatment and the second stage treatment continuously but inserting the processing step for the sintered body between the two stages.

The sintered body obtained from the above processes is cut into a specified size and shape. The processing method for the surface of the sintered body is not particularly limited, and a mechanical processing can be performed. As the mechanical processing, a grinding process using a grindstone can be listed as an example.

EXAMPLES

Hereinafter, the contents of the present invention will be described in detail by using Examples and Comparative Examples, but the present invention is not limited to the following examples.

Example 1

An alloy for a porous body having a composition of 14.4 at % Nd-5.8 at % B-78.8 at % Fe-0.5 at % Al-0.5 at % Cu was prepared by a strip casting method. Similarly, an alloy for slurry was prepared to have the composition of Table 1.

The obtained raw material alloy sheets were hydrogen-pulverized respectively and the raw material alloy sheets were performed with a dehydrogenation treatment at 600° C. to obtain the coarsely pulverized powder.

0.10 wt % of oleic amide was added into the obtained coarsely pulverized powder as the pulverization aid to perform a mixing in the nitrogen gas atmosphere for 10 minutes using a Nauta mixer. Then, the fine pulverization was performed in a high-pressure nitrogen gas atmosphere using an airflow type pulverizer (such as a jet mill) to obtain the finely pulverized powder with an average particle size of 4.0 μm respectively.

The finely pulverized powder for a porous body was pressed in the magnetic field at a nitrogen gas atmosphere. To be specific, pressing was performed in a magnetic field of 15 kOe under a pressure of 140 MPa to obtain a green compact of 20 mm×18 mm×13 mm. The direction of the magnetic field is perpendicular to the pressing direction.

The green compact was subjected to a thermal treatment in an inert gas, i.e., argon, atmosphere at 850° C. for 60 minutes. Additionally, the green compact was treated in the nitrogen gas atmosphere after the thermal treatment in order to prevent oxidization.

Thereafter, the slurry was prepared using the finely pulverized powder of the alloy for slurry. The finely pulverized powder of the alloy for slurry and ethanol was weighed respectively to make a weight ratio of the fine pulverized powder of the alloy for slurry in the slurry become 40 wt % and then put into an ointment container. At that moment, the argon gas was filled into the ointment container in order to prevent a sudden oxidization. Then, a mixing was performed by using a non-bubbling kneader with 1500 rpm for 3 minutes.

The porous body was coated or impregnated with the slurry to have a weight ratio of the slurry of 0.6 wt % relative to the weight of the porous body. The present step was performed in an inert gas atmosphere in order to prevent the oxidization on the surface of the porous body.

The porous body impregnated with the slurry was sintered in a vacuum atmosphere at 1010° C. for 6 hours. The obtained sintered magnet was subjected to a two-stage aging treatment, i.e., at 800° C. for 1 hour and at 500° C. for 1 hour, in Ar gas atmosphere.

The sintered body was measured by a DC magnetization detecting apparatus (such as a B-H tracer) to obtain the demagnetization curve and the magnetic properties were determined from the results of the demagnetization curve. As the magnetic properties, the residual magnetic flux density Br and the coercivity HcJ was measured. The results of the Br and HcJ were shown in Table 2.

The obtained sintered body was embedded into the epoxy resin and the cross-section was grinded using commercially available sandpapers. The sand paper was used from low type to higher one to grind the cross-section. At this moment, the grinding was performed without water or the like since the components in the grain boundary was corroded if the water was used. Then, the cross-section was grinded by a buff and diamond abrasive grains. At last, the cross-section was grinded by ion milling in order to eliminate the influence of the oxide film on the outermost surface.

The cross-section area of the grain boundary part in the unit cross-section area was calculated as follows.

(1) The sintered body after being grinded was applied to observe the structure in the sintered body from the back-scattered electron image using an SEM. As the result, it was confirmed that several phases were present. In order to determine the composition of the phases respectively, an area of 50 μm×50 μm was regarded as a unit cross-section area. The cross-section after being grinded was observed by electron probe microanalysis (hereinafter, denoted as EPMA for convenience) and 5 visual fields selected randomly was subjected to an elemental mapping (256 points×256 points) by means of EPMA. In this way, the main phase grain part and the grain boundary part were determined. Further, the Nd-rich grain boundary phase, the CFC phase, the rare earth oxide phase and the rare earth carbide phase were determined in the grain boundary part.

(2) The cross-section area of the CFC phase was calculated by the image analysis of the each image from five visual fields obtained by EPMA, and then the average of the cross-section area of the CFC phase was obtained. Further, the cross-section area ratio of the CFC phase in the unit cross-section area was calculated by dividing the calculated cross-section area of the CFC phase by the unit cross-section area specified in above (1). The results were shown in Table 2.

The atom concentration of each element in the CFC phase was calculated by quantitative analysis using EPMA. The average value of 5 measured values from 5 places in one sample was deemed as the atom concentration of the sample. The a, was calculated by the following formula (1). The results were shown in Table 2.

$$\alpha=(\text{Ce atom concentration}/(\text{Ce atom concentration}+\text{Fe atom concentration}+\text{Co atom concentration})) \quad (1)$$

The sample used in the corrosion resistance experiment was prepared by processing the sintered body into a plate form with a size of 13 mm×8 mm×2 mm. Thereafter, the plate-like magnet was weighed and then placed into a highly accelerated life tester in a saturated water vapor atmosphere of 100% relative humidity at 120° C. and 2 atm. The plate-like magnet was weighed every 50 hours, and the weight of the plate-like magnet was measured until it was decreased by 1 wt % from the weight at the point of the start of the measurement. The results were shown in Table 2. In addition, when a plate-like magnet needed more than 1000 hours to decrease the weight by 1 wt %, the magnet was determined to have a effect of the corrosion resistance.

Examples 2 to 5 and Comparative Examples 1 to 3

Sintered magnets were prepared in the same way as Example 1 except that the compositions of the alloys for porous body were the same as Example 1 while alloys for slurry were prepared to have the compositions as shown in Table 1 and the weight ratios of the slurry impregnated in the porous body were changed as shown in Table 1. The calculation of the cross-section area ratio of the CFC phase in the unit cross-section area, the calculation of the Co atom concentration and a in the CFC phase and the evaluations of the magnetic properties and the corrosion resistance were carried out in the same way as in Example 1. The results were shown in Table 2.

Comparative Example 4

An alloy for sintered magnet having a composition of 14.4 at % Nd-5.8 at % B-78.8 at % Fe-0.5 at % Al-0.5 at % Cu was prepared by the strip casting method. And other steps were carried out in the same way as in Example 1 till the pressing step. After that, the sample was sintered in a vacuum atmosphere at 1010° C. for 6 hours. The obtained sintered body was subjected to a two-stage aging treatment in an Ar atmosphere at 800° C. for 1 hour and at 500° C. for 1 hour to prepare a sintered magnet. The evaluations of the magnetic properties and the corrosion resistance were carried out in the same way as in Example 1 and the results were shown in Table 2.

Comparative Example 5

An alloy for sintered magnet having a composition of 14.4 at % Nd-5.8 at % B-75.0 at % Fe-3.0 at % Co-0.5 at % Al-0.5 at % Cu was prepared by the strip casting method. And other steps were carried out in the same way as in Example 1 till the pressing step. After that, the sample was sintered in a vacuum atmosphere at 1010° C. for 6 hours. The obtained sintered body was subjected to a two-stage aging treatment in an Ar atmosphere at 800° C. for 1 hour and at 500° C. for 1 hour to prepare a sintered magnet. The evaluations of the magnetic properties and the corrosion resistance were carried out in the same way as in Example 1 and the results were shown in Table 2.

If Examples 1 to 5 and Comparative Examples 1 to 5 were compared, it would be found out that when the ratio of the slurry impregnated in the porous body was within the range of 1.0 wt % or more and 5.5 wt % or less, the cross-section area ratio of the CFC phase in the unit cross-section area became 1.0% or more and 5.0% or less, the corrosion resistance increased and the magnetic properties also showed high values. It was considered that if the cross-section area ratio of the CFC phase in the unit cross-section area was less than 1.0%, the hydrogen produced by the reaction between R and water such as water vapor could not be sufficiently inhibited from storing into the grain boundary, and thus the corrosion resistance would be decreased. On the other hand, it was considered that if the cross-section area ratio of the CFC phase in the unit cross-section area was over 5.0%, the volume ratio of the main phase dropped, so the residual magnetic flux density would decrease. In addition, the corrosion resistance would reduce if Co was not added; however, when Co was added into the alloy, the corrosion resistance would improve but the coercivity would decrease. From these points, it was known that compared to the conventional case, the corrosion resistance could be improved and the decrease of the coercivity could be suppressed in the present invention. The reason was considered that Co could be stabilized by forming a Ce—Fe—Co intermetallic compound and Co would not substitute the Fe in the main phase when specified amount of CFC phase was generated in the grain boundary phase.

TABLE 1

| | Composition of the alloy for slurry | | | |
|---|---|---|---|---|
| | Ce atom concentration [at %] | Co atom concentration [at %] | Fe atom concentration [at %] | Ratio of the slurry impregnated in the porous body [wt %] |
| Example 1 | 27.10 | 3.03 | 69.87 | 0.60 |
| Example 2 | 27.10 | 3.03 | 69.87 | 1.70 |
| Example 3 | 27.10 | 3.03 | 69.87 | 2.60 |
| Example 4 | 27.10 | 3.03 | 69.87 | 3.50 |
| Example 5 | 27.10 | 3.03 | 69.87 | 4.40 |
| Comparative Example 1 | 27.10 | 3.03 | 69.87 | 0.30 |
| Comparative Example 2 | 27.10 | 3.03 | 69.87 | 4.70 |
| Comparative Example 3 | 27.10 | 3.03 | 69.87 | 5.60 |
| Comparative Example 4 | — | — | — | — |
| Comparative Example 5 | — | — | — | — |

TABLE 2

| | Cross-section area ratio of the CFC phase in the unit cross-section area [%] | Co atom concentration in the CFC phase [at %] | α | Br [kG] | HcJ [kOe] | time for decreasing the weight [hr] | Note |
|---|---|---|---|---|---|---|---|
| Example 1 | 1.2 | 2.93 | 0.269 | 13.5 | 12.1 | 1200 | |
| Example 2 | 2.2 | 2.95 | 0.268 | 13.4 | 12.2 | 1200 | |
| Example 3 | 3.1 | 2.93 | 0.269 | 13.2 | 12.2 | 1250 | |
| Example 4 | 3.9 | 2.92 | 0.267 | 13.0 | 11.9 | 1250 | |
| Example 5 | 4.8 | 2.94 | 0.267 | 13.2 | 12.0 | 1200 | |
| Comparative Example 1 | 0.8 | 2.96 | 0.269 | 13.2 | 11.8 | 850 | |
| Comparative Example 2 | 5.6 | 2.91 | 0.268 | 11.1 | 12.1 | 1200 | |
| Comparative Example 3 | 6.4 | 2.92 | 0.269 | 9.8 | 11.9 | 1250 | |
| Comparative Example 4 | — | — | — | 13.4 | 11.9 | 500 | No Co added |
| Comparative Example 5 | — | — | — | 13.2 | 9.4 | 1250 | 3.0 at % of Co added |

Examples 6 to 10 and Comparative Examples 6 to 8

Sintered magnets were prepared in the same way as Example 1 except that the compositions of the alloys for porous body were the same as Example 1 while the compositions of the alloys for slurry and the ratios of the slurry impregnated in the porous body were changed as shown in Table 3. The calculation of the cross-section area ratio of the CFC phase in the unit cross-section area, the calculation of the Co atom concentration and a in the CFC phase and the evaluations of the magnetic properties and the corrosion resistance were carried out in the same way as in Example 1 and the results were shown in Table 4.

If Examples 6 to 10 and Comparative Examples 6 to 8 were compared, it would be found out that when the Co atom concentration in the CFC phase was in the range of 0.5 at % or more and 5.0 at % or less, the corrosion resistance was high and the magnetic properties also showed high values. On the other hand, it was considered that if the Co atom concentration in the CFC phase was lower than 0.5 at % or higher than 5.0 at %, the potential difference between the main phase and the grain boundary phase became large, and the corrosion resistance reduced due to the cell reaction. Further, it was considered that if the atom concentration of Co in the CFC phase was higher than 5.0 at %, the Co which had not been completely substituted in the Ce—Fe—Co intermetallic compound became a soft phase, and thus the coercivity decreased.

TABLE 3

| | Composition of the alloy for slurry | | | |
|---|---|---|---|---|
| | Ce atom concen-tration [at %] | Co atom concen-tration [at %] | Fe atom concen-tration [at %] | Ratio of the slurry impregnated in the porous body [wt %] |
| Example 6 | 23.80 | 0.65 | 75.55 | 3.00 |
| Example 7 | 24.30 | 1.18 | 74.52 | 3.03 |
| Example 8 | 25.10 | 2.72 | 72.18 | 2.98 |
| Example 9 | 25.40 | 4.25 | 70.35 | 3.01 |
| Example 10 | 25.90 | 5.00 | 69.10 | 3.02 |
| Comparative Example 6 | 23.50 | 0.44 | 76.06 | 2.99 |
| Comparative Example 7 | 26.30 | 5.20 | 68.50 | 3.00 |
| Comparative Example 8 | 26.80 | 6.11 | 67.09 | 3.01 |

TABLE 4

| | Cross-section area ratio of the CFC phase in the unit cross-section area [%] | Co atom concentration in the CFC phase [at %] | α | Br [kG] | HcJ [kOe] | Time for decreasing the weight [hr] |
|---|---|---|---|---|---|---|
| Example 6 | 1.6 | 0.62 | 0.247 | 13.4 | 11.9 | 1300 |
| Example 7 | 2.3 | 1.14 | 0.250 | 13.7 | 12.2 | 1350 |
| Example 8 | 2.8 | 2.67 | 0.248 | 13.6 | 12.4 | 1350 |
| Example 9 | 3.6 | 4.18 | 0.246 | 13.5 | 12.3 | 1400 |
| Example 10 | 4.4 | 4.92 | 0.249 | 13.5 | 12.3 | 1450 |
| Comparative Example 6 | 0.9 | 0.40 | 0.244 | 13.3 | 12.4 | 900 |
| Comparative Example 7 | 5.2 | 5.10 | 0.247 | 13.7 | 8.5 | 950 |
| Comparative Example 8 | 5.8 | 6.00 | 0.248 | 13.4 | 7.4 | 900 |

Examples 11 to 15 and Comparative Examples 9 to 11

Sintered magnets were prepared in the same way as Example 1 except that the compositions of the alloys for porous body were the same as Example 1 while the compositions of the alloys for slurry and the ratios of the slurry impregnated in the porous body were changed as shown in Table 5. The calculation of the cross-section area ratio of the CFC phase in the unit cross-section area, the calculation of the Co atom concentration and a in the CFC phase and the evaluations of the magnetic properties and the corrosion resistance were carried out in the same way as in Example 1 and the results were shown in Table 6.

If Examples 11 to 15 and Comparative Examples 9 to 11 were compared, it would be found out that when a was in the range of 0.20 or more and 0.35 or less, the corrosion resistance was high and the magnetic properties also showed high values. It was considered that if a was lower than 0.20 or higher than 0.35, only a part of Co existing in the grain boundary phase would form an intermetallic compound with Ce and Fe and a structure with Co substituting the Fe in the main phase obtained, so the coercivity reduced.

TABLE 5

| | Composition of the alloy for slurry | | | |
|---|---|---|---|---|
| | Ce atom concentration [at %] | Co atom concentration [at %] | Fe atom concentration [at %] | Ratio of the slurry impregnated in the porous body [wt %] |
| Example 11 | 21.10 | 0.90 | 78.00 | 3.10 |
| Example 12 | 24.20 | 1.60 | 74.20 | 2.95 |
| Example 13 | 27.50 | 2.55 | 69.95 | 3.03 |
| Example 14 | 30.55 | 3.70 | 65.75 | 2.97 |
| Example 15 | 32.00 | 4.80 | 63.20 | 3.06 |
| Comparative Example 9 | 18.30 | 0.50 | 80.39 | 3.04 |
| Comparative Example 10 | 36.40 | 5.30 | 60.28 | 3.07 |
| Comparative Example 11 | 40.50 | 5.90 | 53.60 | 3.04 |

TABLE 6

| | Cross-section area ratio of the CFC Phase in the unit cross-section area [%] | Co atom concentration in the CFC phase [at %] | α | Br [kG] | HcJ [kOe] | Time for decreasing the weight [hr] |
|---|---|---|---|---|---|---|
| Example 11 | 1.4 | 0.85 | 0.204 | 13.6 | 12.4 | 1300 |
| Example 12 | 2.2 | 1.50 | 0.237 | 13.3 | 12.7 | 1350 |
| Example 13 | 3.0 | 2.45 | 0.271 | 13.4 | 12.8 | 1400 |
| Example 14 | 3.8 | 3.60 | 0.301 | 13.2 | 12.6 | 1400 |
| Example 15 | 4.7 | 4.75 | 0.344 | 13.6 | 12.8 | 1450 |
| Comparative Example 9 | 0.8 | 2.55 | 0.172 | 13.5 | 8.7 | 1300 |
| Comparative Example 10 | 5.3 | 5.15 | 0.360 | 13.4 | 8.5 | 1350 |
| Comparative Example 11 | 5.7 | 5.80 | 0.401 | 13.1 | 8.2 | 1400 |

Example 16

The porous body was prepared in the same way as Example 1 except that the composition of the alloy for porous body was prepared to be 7.2 at % Nd-7.2 at % Y-5.8 at % B-78.8 at % Fe-0.5 at % Al-0.5 at % Cu. The sintered magnet was prepared in the same way as Example 1 except that the composition of the alloy for slurry and the ratio of the slurry impregnated in the porous body were changed as shown in Table 7. The calculation of the cross-section area ratio of the CFC phase in the unit cross-section area, the calculation of the Co atom concentration and a in the CFC phase and the evaluations of the magnetic properties and the corrosion resistance were carried out in the same way as in Example 1 and the results were shown in Table 8.

Example 17

The porous body was prepared in the same way as Example 1 except that the composition of the alloy for porous body was prepared to be 7.2 at % Nd-6.0 at % Y-1.2 at % Ce-5.8 at % B-78.8 at % Fe-0.5 at % Al-0.5 at % Cu. The sintered magnet was prepared in the same way as Example 1 except that the composition of the alloy for slurry and the ratio of the slurry impregnated in the porous body were changed as shown in Table 7. The calculation of the cross-section area ratio of the CFC phase in the unit cross-section area, the calculation of the Co atom concentration and a in the CFC phase and the evaluations of the magnetic properties and the corrosion resistance were carried out in the same way as in Example 1 and the results were shown in Table 8.

It could be known from Example 16 and Example 17 that even when a part of R in the porous body was substituted by Y and Ce, the corrosion resistance was also high and no decrease could be found in the magnetic properties.

TABLE 7

| | Composition of the alloy for slurry | | | |
|---|---|---|---|---|
| | Ce atom concentration [at %] | Co atom concentration [at %] | Fe atom concentration [at %] | Ratio of the slurry impregnated in the porous body [wt %] |
| Example 16 | 25.10 | 2.67 | 72.23 | 3.10 |
| Example 17 | 20.30 | 2.67 | 77.03 | 3.05 |

TABLE 8

| | Cross-section area ratio of the CFC phase in the unit cross-section area [%] | Co atom concentration in the CFC phase [at %] | α | Br [kG] | HcJ [kOe] | Time for decreasing the weight [hr] |
|---|---|---|---|---|---|---|
| Example 16 | 3.3 | 2.63 | 0.248 | 13.2 | 12.4 | 1300 |
| Example 17 | 2.9 | 2.63 | 0.198 | 12.9 | 12.1 | 1250 |

As set forth above, the R-T-B based sintered magnet according to the present invention has an excellent motor performance when used as the magnet for rotating machine such as motor and can be used in a long term because of the high corrosion resistance. Thus, the R-T-B based sintered magnet according to the present invention is suitable for the R-T-B based sintered magnet for motor.

What is claimed is:

1. An R-T-B based sintered magnet comprising a main phase composed of an $R_2T_{14}B$ structure, wherein:

R is at least one selected from the group consisting of Y, Ce, La, Pr, Nd, Sm, Eu and Gd, with Ce as a necessity;

T is one or more transition metal elements with Fe as a necessity, the R-T-B based sintered magnet has a grain boundary phase containing Ce, Fe, and Co, the cross-section area ratio of the grain boundary phase containing Ce, Fe, and Co in a unit cross-section area is 1.2% or more and 4.8% or less, a Co atom concentration in the grain boundary phase containing Ce, Fe, and Co is 0.62 at. % or more and 4.92 at. % or less, and a ratio of a Ce atom concentration relative to a sum of the Ce atom concentration, a Fe atom concentration, and the Co atom concentration in the grain boundary phase containing Ce, Fe, and Co is 0.198 or more and 0.344 or less.

* * * * *